United States Patent [19]

Vermeulen

[11] 4,223,455

[45] Sep. 23, 1980

[54] SHOE SOLE CONTAINING DISCRETE AIR-CHAMBERS

[76] Inventor: Jean-Pierre Vermeulen, 2489 Queen St. East, Toronto, Ontario, Canada, M4E 1H9

[21] Appl. No.: 896,739

[22] Filed: Apr. 17, 1978

[30] Foreign Application Priority Data

Apr. 12, 1978 [CA] Canada ..... 301423

[51] Int. Cl.[2] ..... A43B 13/20

[52] U.S. Cl. ..... 36/29; 36/3 B

[58] Field of Search ..... 36/28, 29, 3 R, 3 B

[56] References Cited

U.S. PATENT DOCUMENTS

| | | | |
|---|---|---|---|
| 945,698 | 1/1910 | Conway | 36/3 B |
| 1,605,408 | 11/1926 | Huiskamp | 36/3 B |
| 2,968,105 | 1/1961 | Rizzo | 36/29 X |
| 2,985,971 | 5/1961 | Murawski | 36/29 |
| 3,253,355 | 5/1966 | Menken | 36/29 |
| 3,834,046 | 9/1974 | Fowler | 36/28 |

FOREIGN PATENT DOCUMENTS

| | | | |
|---|---|---|---|
| 506416 | 8/1937 | United Kingdom | 36/3 B |

*Primary Examiner*—James Kee Chi

*Attorney, Agent, or Firm*—George H. Riches

[57] ABSTRACT

A novel shoe incorporating a new sole and wedge-shaped arch support. The sole includes a plurality of sealed alveoli or air-chambers of different shapes which provide sufficient flexibility and resiliency to the shoe to reduce many of the common problems encountered by athletes. The alveoli are sealed in the sole by a mid-sole and an air-chamber member being sealed together in a simple and efficient manner.

14 Claims, 11 Drawing Figures

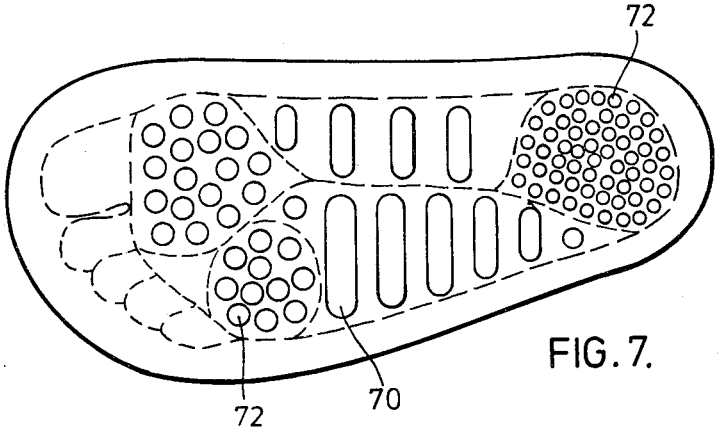
FIG. 7.
FIG. 8.
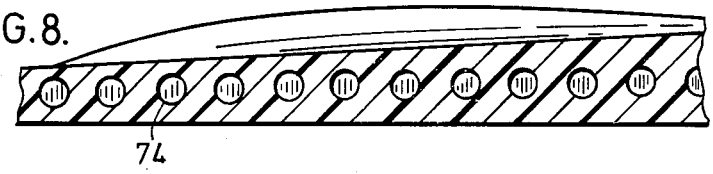
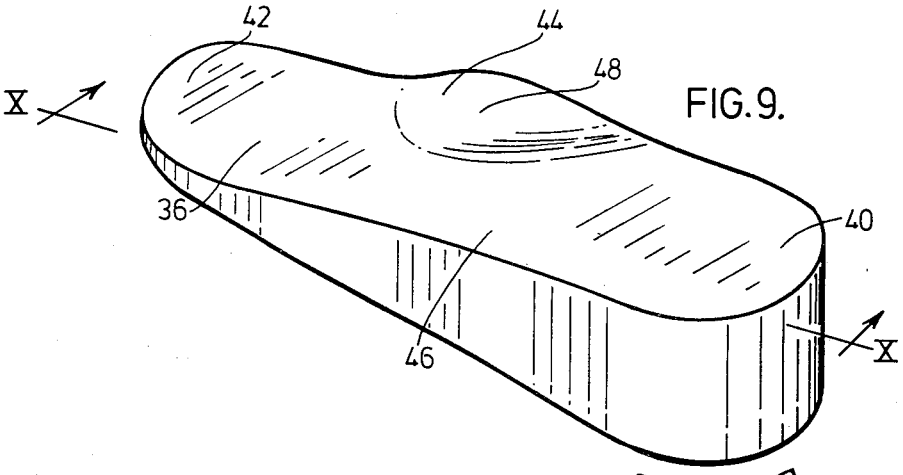
FIG. 9.
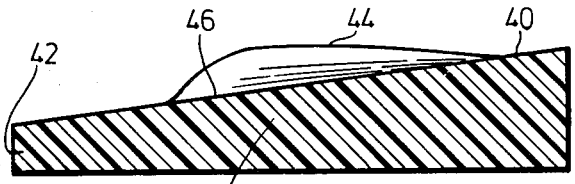
FIG. 10.
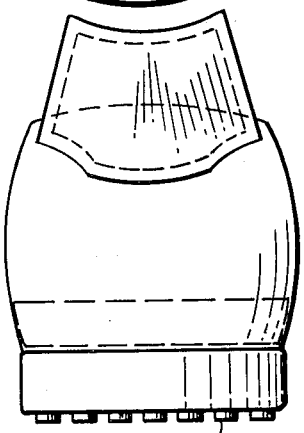
FIG. 11.

SHOE SOLE CONTAINING DISCRETE AIR-CHAMBERS

BACKGROUND OF THE INVENTION

1. Field of the Invention

This invention relates generally to shoes and more particularly, to a sole which is suitable for use in an athletic shoe for use by runners, joggers and the like.

2. Description of the Prior Art

One of the problems encountered by runners, joggers, walkers and other athletes (hereinafter for brevity, referred to as runners) is the lack of a shoe and in particular, a shoe containing a sole which is designed and manufactured to meet and compensate for the problems associated with the physical act of running.

Many injuries encountered in the various activities which involve running or walking are directly attributable to the footwear worn by the runner. Examples of these injuries include tendonitis, fallen arches, damaged knees, etc. They occur primarily because the footwear worn does not compensate for the stress which is applied to various parts of the foot during the running activity, stiffness in the footwear and the lack of flexibility and stability in the sole of the footwear worn.

In those shoes which have attempted to overcome these problems, a further problem has arisen which is that these shoes wear out very quickly and must be discarded after a short period of use, thereby increasing tremendously the participatory costs of the activity incurred by the participant.

Canadian Pat. No. 377,764 issued on Nov. 15, 1938 to Arthur Fisch shows an early attempt to compensate for problems encountered by users of these types of footwear. While this patent relates particularly to "house shoes" and not directly to athletic footwear, it attempts to provide a shoe which allows for the natural rolling of the foot from heel to toe by using a series of studs or projections underneath the arch support and a plurality of arch supporting ribs and a series of web forming cells underneath the toe portions. While this structure improves the resiliency of the shoes, it does not provide sufficient support and resiliency for use by runners. Also, the shoe provides no means to prevent pronation which may occur during running or similar activities.

U.S. Pat. No. 2,090,881 granted to Wilson on Aug. 24, 1937 provides a cushioning member for use as an insole or an outsole to retain the resiliency of the shoe and to ease the pressure created when the shoe contacts the ground. A plurality of individual air-filled cells are used as the cushioning mechanism with each cell sealed.

While this shoe increases the cushioning effect of a shoe, it does not prevent pronation of the foot which is the cause of many injuries.

Similarly, the shoe disclosed in U.S. Pat. No. 2,553,616 granted to Walls on May 22, 1951 addressed itself to some of the problems encountered by runners but provides no solution to prevent rapid pronation.

These foregoing examples and other sole systems used in the prior art utilize a plurality of inclined flat layers of different material such as gums, rubbers, elastics and other synthetic materials to create an elevation of the sole of approximately one inch at the heel portion of the shoe which gradually decreases towards the toe portion of the sole.

SUMMARY OF THE INVENTION

Accordingly, it is an object of the present invention to at least partially overcome these disadvantages by providing a novel sole and a shoe utilizing this sole which reduces the injuries suffered by runners during the performance of athletic activities yet provides the required flexibility and resiliency in the shoe.

It is a further object of this invention to provide a sole and a shoe utilizing the sole which has the necessary durability to withstand normal use by an athlete.

It is a still further object of the present invention to provide a sole which will distribute the stress and weight created when the foot of a runner contacts the ground, more evenly over the entire sole to reduce the stress and strain on particularly vulnerable places in the leg and ankle of the runner.

To this end, in one of its objects, the invention provides a sole for use in a shoe, said sole comprising:

(a) a base member;
(b) a mid-sole containing a plurality of alveoli;
(c) an air-chamber member comprising a thin, resilient member adapted to seal said alveoli thereby providing a plurality of sealed air-chambers in said sole;
(d) an upper sealing member adapted to overlap said air-chamber member.

In another of its aspects, the invention further provides a one-piece sole for use in an athletic shoe which comprises:

(a) a base member carrying on its underneath surface, a plurality of ground gripping studs;
(b) a thin, lower sealing member;
(c) a mid-sole containing a plurality of alveoli extending from the top surface of said mid-sole downwardly to a point marginally above the bottom surface of said mid-sole, the height of said mid-sole greater at the heel portion than at the toe portion; and the concentration of said alveoli greater in the portion of the mid-sole corresponding to the ball and joint of the foot and the lateral side of said mid-sole;
(d) an air-chamber member comprising a thin, resilient member with a plurality of downwardly depending, open-topped air-chambers, said air-chambers corresponding in size, shape and position to said alveoli in said mid-sole;
(e) an upper sealing member adjusted to overlay said air-chamber member and to seal said air-chambers.

In still another of its aspects, the invention provides an improved shoe which consists of an upper portion and a sole portion, one improvement comprising:

(a) a base member carrying on its underneath surface, a plurality of ground gripping studs;
(b) a thin, lower sealing member;
(c) a mid-sole containing a plurality of alveoli extending from the top surface of said mid-sole downwardly to a point marginally above the bottom surface of said mid-sole, the height of said mid-sole greater at the heel portion than at the toe portion; and the concentration of said alveoli greater in the portion of the mid-sole corresponding to the ball and plant of the foot and the lateral side of said mid-sole;
(d) an air-chamber member comprising a thin, resilient member with a plurality of downwardly depending, open-topped air-chambers, said air chambers corresponding in size, shape and position to said alveoli in said mid-sole;

(e) an upper sealing member adjusted to overlay said air-chamber member and to seal said air-chambers;

and a wedge inserted in said shoe on the top of said upper sealing member of said sole, said wedge consisting of a wedge-shaped arch support for use in a shoe which comprises a raised area corresponding to the heel of the foot, the lateral portion of the wedge decreasing in height from the heel to the toe and the medial portion sloping marginally from the heel forward to the ball portion of the foot then convexly downward to the toe.

In yet another of its aspects, the invention further provides a wedge-shaped arch support for use in a shoe which comprises a round area corresponding to the heel of the foot, the lateral portion of the wedge decreasing in height from the heel to the toe and the medial portion sloping marginally from the heel forward to the ball portion of the foot then convexly downward to the toe.

BRIEF DESCRIPTION OF THE DRAWINGS

Further objects and advantages of the invention will appear from the description taken together with the accompanying drawings in which:

FIG. 7 is a top view of a fourth embodiment of the mid-sole;

FIG. 8 is a side view of a fifth embodiment of the sole of the present invention;

FIG. 9 is a rear perspective view showing the heel of the shoe and the wedge of the present invention;

FIG. 10 is a side view of the wedge along line X—X of FIG. 9;

FIG. 11 is a rear view of the wedge and protector of the present invention.

DESCRIPTION OF THE PREFERRED EMBODIMENT

Figure 1:
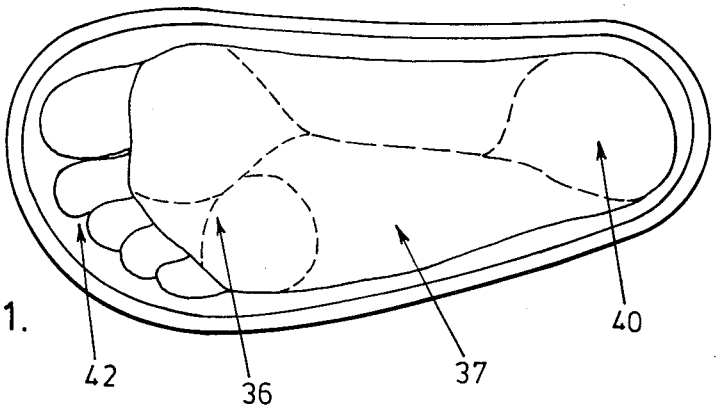
FIG. 1 is an underneath view showing a foot inside the outline of the sole of a shoe.

In order to best understand the present invention and the manner in which it alleviates the problems caused by running, an explanation of these problems and resulting injuries encountered by runners, joggers and the like will be made first.

The problems encountered by runners are many and most result from an unnatural pressure applied to the foot or leg during the act of running. As the foot is placed on the ground, it is forced to quickly turn unnaturally thereby placing strain on the tendons in the ankle and leg which eventually results in tendonitis. Most shoes on the market do not have the required flexibility and support to prevent this from occurring and those that do are so soft and flexible that they wear out too quickly.

In order to achieve this flexibility, some manufacturers will use a very soft material such as foam or a synthetic foam rubber. However, these materials are too soft and wear out very quickly. If the material is too soft, in addition to wearing out, blisters will occur very rapidly on the runner's feet and the lack of support in the shoe will cause the foot to "wobble". If on the other hand, the shoe is too hard, the stress applied to the feet of the runner is intensified causing serious damage.

The manner in which a runner lands on his feet differs with a variance in the speed at which he is travilling. If a person is running a mile in about 7 to 10 minutes, that is, when he is jogging, he will usually land very hard on the heel part of the foot. If he is running a faster mile, say in about five to seven minutes, the runner will usually land on the plant or ball portion of the foot.

When the runner lands on his foot, the foot will turn over from the lateral to the medial side. There is little or no flexibility in this movement and this "turning" of the foot is called "pronation". When a runner lands on the medial side and rotates or turns over to the lateral side, this is referred to as "supination".

The runner in the normal running position pronates as he lands and if there is no flexibility, this forces the foot to land flat on the ball portion. The stress and weight is therefore applied to the arch portion of the foot which may eventually result in collapsed or fallen arches.

The object and design of the shoe of the present invention is to allow the foot to pronate slowly to relieve the stress and pressure created by rapid pronation. When a runner slowly pronates as the foot contacts the ground, the stress and weight is removed from the leg and such problems as knee injuries, shin splints, fallen or collapsed arches, achilles tendonitis and cartilage damage are remarkedly reduced.

The present invention uses an air suspension system in the sole to reduce the effects of the impact of the foot on the ground and to prevent or reduce rapid pronation.

However, it must be remembered that supination is equally as detrimental as rapid pronation. The pronation must now be slow enough to allow a natural, supported rolling action of the foot to avoid the use of the tendons in the ankle and leg.

The sole of the present invention may be of different embodiments to produce the desired air suspension system. Several of these embodiments are shown in the drawings to which reference is now made.

Figure 2:
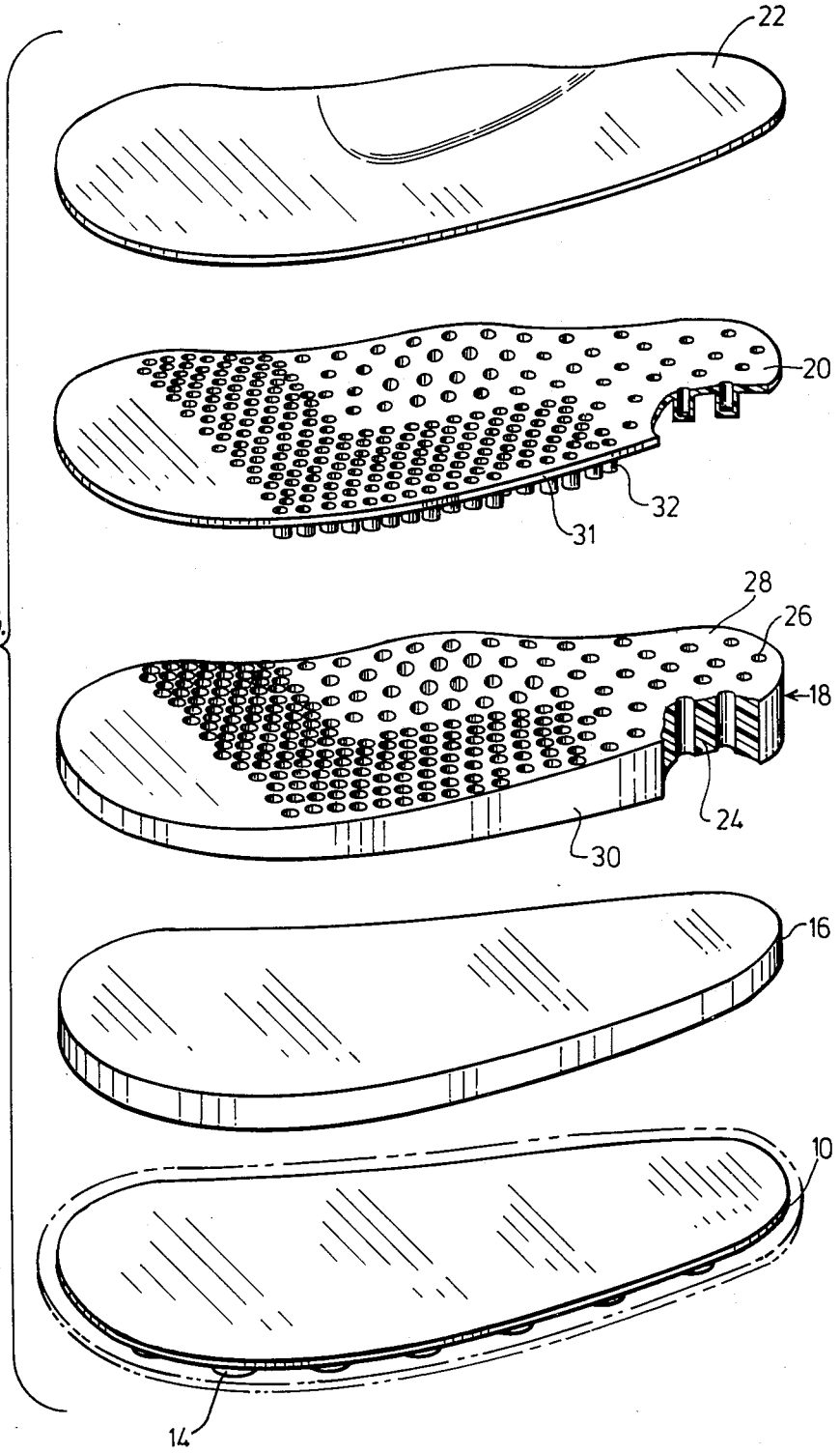
FIG. 2 is an exploded view of the component layers of one embodiment of the invention.

In the first embodiment shown in FIG. 2 of the drawings, the sole (from the bottom upwards) consists of a base member 10 which acts as the ground contacting surfaces. The base member 10 may be of the same size as the rest of the shoe or may be of larger dimensions shown in dotted lines in FIG. 2. The base member 10 may also carry on its underneath surface, a plurality of ground gripping studs 14 which may be of any design well-known in the art.

Placed above the base member 10, is a lower sealing member 16. This lower sealing member may be of any desired thickness, and preferably is about 1 mm thick. If desired, this member 16 may be constructed as a pad to provide increased resiliency to the sole. The pad may be made of a microcellular synthetic foam to provide additional protection for the runner.

The lower sealing member 16 may be omitted within the scope of the invention. In addition to its function to seal the lower portion of the side, this member also adds resiliency to the sole and reduces the wear on the mid-sole 18. However, this member may be omitted to reduce the weight of the shoe and its cost of manufacture, if desired.

After the lower sealing member 16, is placed the mid-sole 18 of the shoe of the embodiment of the present invention. The mid-sole 18 consists of a solid portion 24 and a plurality of alveoli 26 which extend from the top surface 28 to a point marginally above the bottom surface 30 of the mid-sole 18.

The mid-sole 18 of the shoe is the base supporting structure of the sole. It must be resilient yet flexible enough to allow for the normal bending action of any sole during the running activity. Any suitable material may be used and an example thereof is resilient foam rubber.

The purpose of the mid-sole 18 is to provide an integrated air-suspension arch support for the shoe. The alveoli are provided to accommodate the air-chambers 32 (as explained hereinafter) and the shape of the mid-sole provides additional support for the foot. It increases in height from front to back as shown in FIG. 2 to relieve the stress and pressure applied to the arch of the foot during running.

The next layer is an air-chamber member 20 which carries a plurality of air-chambers 32 extending downwardly from the lower surface 31. These air-chambers 32 correspond to and are complimentary to the alveoli 26 in the mid-sole 18 and when assembled, fit within the alveoli 26.

The shape of the alveoli and the chambers are not restricted to any particular shape as long as they are complementary to each other. The inventor has found that to simplify manufacture of the sole, either a cylindrical or a rectangular (or square) shape is suitable and preferably the square shape is used. The spacing between the chambers or the alveoli may also vary, but preferably, is from 2 to 4 mm.

The depth of the air-chamber member 20 is variable within the scope of this invention and preferably is about one-half amillimeter in thickness. As noted before, the size, shape and positioning of the air-chambers 32 may be varied provided that the air-chambers 32 and the alveoli correspond and are complementary to each other.

The depth of the air-chambers and the alveoli decrease towards the front of the sole as the depth of the mid-sole decreases as shown in FIG. 2. In one embodiment, the air-chambers were two cm in depth at the heel portion and decreased to one cm at the toe portion of the sole. However, the diameter of the air-chambers should remain constant to provide the necessary effect.

On the top of the air-chamber member 20 which carries the air-chambers 32, is a second sealing member 22 which acts to seal the air-chambers 32.

Figure 3:
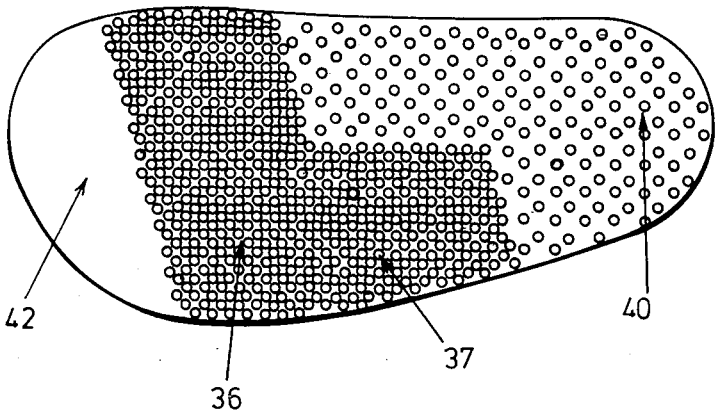
FIG. 3 is a top view of the mid-sole of the sole shown in FIG. 2.

The alveoli 26 extend substantially the height of the mid-sole 18. Their height may be varied according to the desired height of the mid-sole 18 but in the preferred embodiment, are approximately 2 centimeters in height at the rear and 1 cm at the toe portion, as described hereinbefore. They are distributed about the surface of the mid-sole 18 and as shown in FIG. 3, are more numerous in the area of the sole underneath the ball area of the foot 36 and extending rearwardly on the lateral side 37 of the sole member. The alveoli 26 are less dense on the heel portion 40 and may or may not be found on the toe portion 42.

The mid-sole 18 and the other layers of the system may be manufactured of any rubber or rubberized material which is well known in the art.

To assemble the various components of the sole, any suitable process may be used and each layer may be easily vulcanized and secured to the immediately adjacent layers in a simple and mechanical process.

Figure 4:
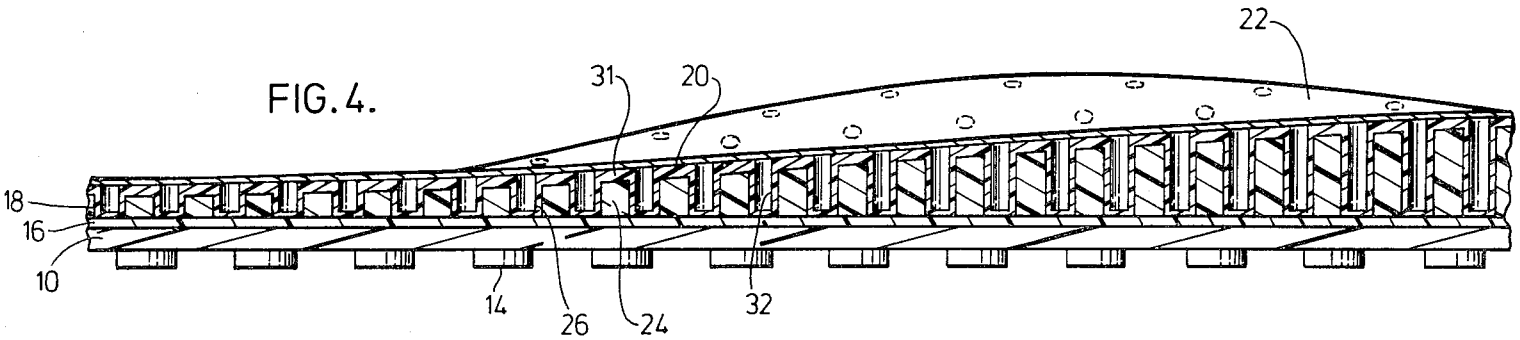
FIG. 4 is a sectional side view of the assembled sole system of FIG. 2.

When assembled as shown in FIG. 4, the sole of the present invention acts as a type of shock absorber which absorbs the shock as the foot of the runner contacts the ground. As pressure is applied, the air within the sealed chambers 32 contracts and distributes the pressure throughout the entire sole. The combination of the air-chambers and the resilient material absorbs the impact and allows the foot to roll or to gently pronate.

Figure 5:
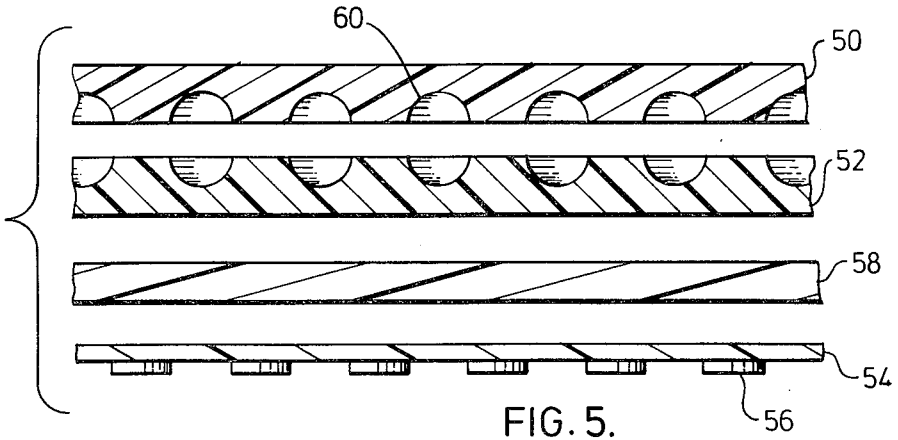
FIG. 5 is an exploded side view of a second embodiment of the present invention.

A second embodiment of the present invention is shown in FIG. 5. This embodiment includes a base member 54 which may carry ground gripping studs 56 on its underneath surface, an optional lower sealing member 58 to provide additional resiliency, mid-sole 52 and air-chamber member 50. In this embodiment, the alveoli 60 are formed by opposite and complementary semi-circular depressions set in the upper surface of the mid-sole 52 and in the lower surface of the air-chamber member 50. These two members are sealed together to form the alveoli to trap air therein. The shape of the depressions should preferably be semi-circular to provide the necessary support and prevent collapse of the structure.

Figure 6:
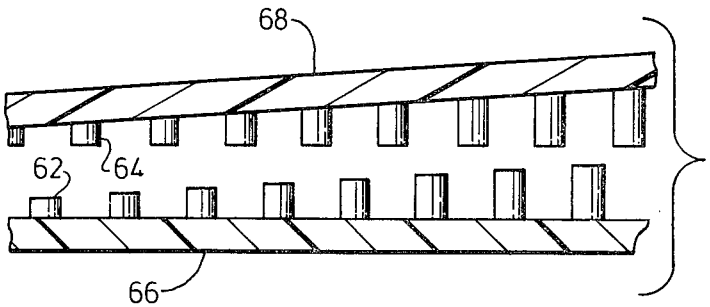
FIG. 6 is a side view of a third embodiment of the mid-sole of the present invention.

Another embodiment is shown in FIG. 6 of the drawings. In this embodiment, the alveoli 62 of the mid-sole 66 and the air-chambers 64 of the air-chamber member 68 are off-set so that when placed together each alveoli is adjacent the complementary air-chamber. When sealed together, the mid-sole 66 and the air-chamber member 68 effectively seal the alveoli 62 and the air-chambers 64 to form a plurality of chambers containing trapped air. This construction also provides good resiliency and is very light-weight.

A further embodiment of the invention is shown in FIG. 7 which shows a different shape of the air-chambers. In this embodiment, the shape of the alveoli 70 are rectangular with rounded ends on the lateral and medial sides of the shoe and circular 72 at the heel portion and the ball and plant portions of the foot.

A still further embodiment is shown in FIG. 8 of the drawings. The inventor has found that a sole having good resiliency and shock absorption may also be made wherein the alveoli are formed by a plurality of tunnel-like passages 74 formed laterally through the sole. In this case, the mid-sole and the air-chamber member are a single unit and the passages are formed laterally through the entire sole. The sole may be made of normal rubber stock or polyvinyl chloride and a particular advantage is the reduced weight of the sole which is particularly advantageous for runners. The shape of the passages is not restricted to cylindrical, and, may be of any desired shape.

To further relieve the pressure applied to the arches of the foot, the present inventor has invented an arch support or wedge which when used with the sole, reduces and in many cases, eliminates the problem of fallen arches in runners.

As shown in FIG. 10 (in side view), the arch support or wedge includes a raised area 44 which is built up on the upper sealing member 22 across the heel portion 40 of the shoe. Just in front of the heel portion 40 of the shoe, the outside or lateral portion 46 of the wedge decreases in height in a straight line to the ball of the foot 36 as shown in FIG. 9. On the other hand, the inside or medial line 48 follows a sloping line forward for about one-half the length of the shoe, then convexly downwards shown in FIG. 10.

The top surface of the wedge is gently sloped downward from the heel to toe portion of the shoe and also from the lateral to medial sides. By supporting the arch in this manner, the foot of the runner is forced to gently pronate when contacting the ground during running. The build-up of the arch support or wedge at the heel may be of any desired height, although from about 1 to 4 mm has proven effective and results have been achieved with a build-up of about 4 mm.

The support or wedge used in the present invention differs from the wedges used in the prior art in that its height at the heel is the same on both sides of the sole. Just in front of the heel, the outside or lateral portion 46 descends in a straight line to the ball of the foot whereas the inside or medial line 48 follows a sloping line forward for about half the length of the shoe, then convexly downwards as the wedge of the prior art.

This wedge may be supplied together with or independently of the sole and shoe. Since each foot may differ in its actual construction, it is important to fit the wedge properly in the shoe and minor variations may be made in the design to accommodate each individual's foot.

In the drawings of the present application, the dimensions of various components have been exaggerated to show the invention and its embodiments. These drawings are merely exemplary and the invention is not restricted to the particular designs as shown.

Although the disclosure describes and illustrates a preferred embodiment of the invention, it is to be understood the invention is not restricted to this particular embodiment.

What I claim is:

1. A sole for use in a shoe, said sole comprising:

(a) a base member;

(b) a mid-sole containing a plurality of discrete, vertically-aligned alveoli;

(c) an air-chamber member comprising a thin, resilient member adapted to seal said discrete, vertically-aligned alveoli thereby providing a plurality of discrete, vertically-aligned sealed air-chambers in said sole;

(d) an upper sealing member adapted to overlay said air-chamber member.

2. A sole for use in a shoe as claimed in claim 1, wherein said mid-sole contains a plurality of discrete, vertically-aligned alveoli extending from the top surface of said mid-sole downwardly to a point marginally above the bottom surface of said mid-sole;

and said air-chamber member comprises a thin, resilient member with a plurality of downwardly depending, open-topped discrete air-chambers, said air-chambers corresponding in size, shape and position to the alveoli in said mid-sole.

3. A sole as claimed in claim 1 or 2 wherein said base member carries on its underneath surface, a plurality of ground gripping studs.

4. A sole as claimed in claim 2 further including a lower sealing member which is about 1 mm in thickness, said lower sealing member between said base member and said mid-sole.

5. A sole as claimed in claim 2 wherein said mid-sole has a greater height at its rear portion then at its front portion.

6. A sole as claimed in claim 2 wherein the concentration of alveoli in said mid-sole is greater in the portion of the mid-sole corresponding to the ball and plant of the foot and the lateral side of said mid-sole.

7. A sole as claimed in claim 6 wherein said alveoli are cylindrical or rectangular.

8. A sole as claimed in claim 6 wherein said alveoli are square.

9. A sole as claimed in claim 6 wherein the depth of said alveoli increases from the front to the rear of said mid-sole.

10. A sole as claimed in claim 2 which is manufactured from rubber and each layer is vulcanized to the immediately adjacent layers.

11. A sole for use in a shoe as claimed in claim 1 wherein said mid-sole includes a plurality of semi-circular depressions on its upper surface and said air-chamber member includes a plurality of identical and complementary semi-circular depressions on its lower surface, said plurality of depressions forming said plurality of discrete, vertically-aligned sealed air-chambers when said mid-sole and said air-chamber are sealed together.

12. A sole for use in a shoe as claimed in claim 1 wherein said air-chamber member further includes a plurality of alveoli depending downwardly from its lower surface, each of the alveoli of the air-chamber member off-set with a corresponding alveoli of the mid-sole and adapted to form a continuous series of alternate discrete sealed air-chambers when said mid-sole and said air-chamber member are sealed together.

13. A one-piece sole for use in an athletic shoe which comprises:

(a) a base member carrying on its underneath surface, a plurality of ground gripping studs;

(b) a thin, lower sealing member;

(c) a mid-sole containing a plurality of discrete, vertically-aligned alveoli extending from the top surface of said mid-sole downwardly to a point marginally above the bottom surface of said mid-sole, the height of the said mid-sole greater at the heel portion than at the toe portion; and the concentration of said alveoli greater in the portion of the mid-sole corresponding to the ball and plant of the foot and the lateral side of said mid-sole;

(d) an air-chamber member comprising a thin, resilient member with a plurality of downwardly depending, open-topped discrete air-chambers, said air-chambers corresponding in size, shape and position to said alveoli in said mid-sole;

(e) an upper sealing member adjusted to overlay said air-chamber member and to seal said air-chambers.

14. In a shoe comprising an upper portion and a sole portion, the improvement comprising the sole consisting of a one-piece sole for use in an athletic shoe which comprises:

(a) a base member carrying on its underneath surface, a plurality of ground gripping studs;

(b) a thin, lower sealing member;

(c) a mid-sole containing a plurality of discrete, vertically-aligned alveoli extending from the top surface of said mid-sole downwardly to a point marginally above the bottom surface of said mid-sole, the height of said mid-sole greater at the heel portion than at the toe portion; and the concentration of said alveoli greater in the portion of the mid-sole corresponding to the ball and plant of the foot and the lateral side of said mid-sole;

(d) an air-chamber member comprising a thin, resilient member with a plurality of downwardly depending, open-topped discrete air-chambers, said air-chambers corresponding in size, shape and position to said alveoli in said mid-sole;

(e) an upper sealing member adjusted to overlay said air-chamber member and to seal said air-chambers;

and a wedge inserted in said shoe on the top of said upper sealing member of said sole, said wedge consisting of a wedge-shaped arch support for use in a shoe which comprises a raised area corresponding to the heel of the foot, the lateral portion of the wedge decreasing in height from the heel to the toe and the medial portion sloping marginally from the heel forward to the ball portion of the foot then convexly downward to the toe.

* * * * *